US008414149B2

(12) United States Patent
Nearman

(10) Patent No.: US 8,414,149 B2
(45) Date of Patent: Apr. 9, 2013

(54) LIGHT ELEMENT SEAL MODULE AND METHOD FOR SAME

(75) Inventor: Nathan Lane Nearman, Brookings, SD (US)

(73) Assignee: Daktronics, Inc., Brookings, SD (US)

( * ) Notice: Subject to any disclaimer, the term of this patent is extended or adjusted under 35 U.S.C. 154(b) by 278 days.

(21) Appl. No.: 12/859,833

(22) Filed: Aug. 20, 2010

(65) Prior Publication Data

US 2011/0051409 A1 Mar. 3, 2011

Related U.S. Application Data

(60) Provisional application No. 61/236,738, filed on Aug. 25, 2009.

(51) Int. Cl.
*F21V 5/00* (2006.01)

(52) U.S. Cl.
USPC ..... 362/246; 362/231

(58) Field of Classification Search ..... 362/249.02, 362/246, 231; 428/28; 257/E33.056; 348/383, 348/836
See application file for complete search history.

(56) References Cited

U.S. PATENT DOCUMENTS

| | | | |
|---|---|---|---|
| 5,914,698 | A | 6/1999 | Nicholson et al. |
| 2002/0122134 | A1 | 9/2002 | Kalua |

FOREIGN PATENT DOCUMENTS

| | | | |
|---|---|---|---|
| CN | 201233693 | A | 5/2009 |
| JP | 2001-249629 | A | 9/2001 |

OTHER PUBLICATIONS

"European Application Serial No. 10173811, Response filed Sep. 22, 2011 to European Search Report mailed Apr. 4, 2011", 9 pgs.
"European Application No. 10 173 811.0-1231, Communication Under Rule 71(3)EPC dated Mar. 1, 2012", 5 pgs.
"European Application Serial No. 10173811, Extended European Search Report mailed Feb. 24, 2011", 8 pgs.

*Primary Examiner* — Anne Hines
(74) *Attorney, Agent, or Firm* — Schwegman, Lundberg & Woessner, P.A.

(57) ABSTRACT

An LED panel assembly includes a circuit board having a plurality of LEDs. An LED seal louver is coupled over the circuit board. The LED seal louver includes a substrate and a pliable seal membrane. The substrate includes one or more substrate cavities. The pliable seal membrane is coupled with the substrate, and the pliable seal membrane includes a pliable material partially extending across the one or more substrate cavities. One or more LED passages extends through the pliable material adjacent to the substrate cavities. Each of the LED passages is sized and shaped to receive a single LED. Bulbs for one or more of the plurality of LEDs are correspondingly received within the LED passages, and the pliable material seals around each bulb with an interference fit. The bulbs are directly visible through the LED seal louver while the pliable seal membrane is sealed around the bulbs, and the circuit board is concealed by the LED seal louver and isolated from an environment exterior to the LED panel assembly.

15 Claims, 7 Drawing Sheets

LIGHT ELEMENT SEAL MODULE AND METHOD FOR SAME

CLAIM OF PRIORITY

This patent application claims the benefit of priority, under 35 U.S.C. §119(e), to Nathan L. Nearman, U.S. Provisional Patent Application Ser. No. 61/236,738, entitled "LIGHT ELEMENT SEAL MODULE AND METHOD FOR SAME," filed on Aug. 25, 2009, which is hereby incorporated by reference herein in its entirety.

TECHNICAL FIELD

LED displays and sealing of the same.

BACKGROUND

Some examples of LED display modules incorporate an arrangement of a plurality of different colored LEDs, such as Red-Green-Blue colors known as an LED package. The LED package includes a circuit board with the LEDs coupled thereon and extending from the circuit board. In one example, to protect the circuit board from the surrounding environment, a potting material is poured over the circuit board, the circuit board is moved into an oven, and the potting material is cured on the circuit board in the oven. The cured potting material isolates and seals the circuit board. In another example, an ultraviolet protective coating or parylene coating is applied to protect the circuit board.

Potting and other coatings have a number of drawbacks. The materials to pot and coat are heavy and expensive. LED display modules are thereby correspondingly heavy and expensive. Further, as described above, potting requires multiple manufacturing and handling steps for application to the LED display module. Moreover, the LEDs extending from the circuit board are often bent during the potting process. Bent LEDs either fail entirely or cause inconsistencies in video and picture quality, color and contrast as light from the bent LEDs is readily distinguishable from light generated from LEDs that are properly aligned on the circuit board. To correct issues with bent LEDs technicians must manually straighten or replace bent LEDs after manufacture. For large LED display modules, such as scoreboards, jumbo viewing screens and the like manual correction of bent LEDs can be labor and time intensive, and thereby expensive to the buyer and/or manufacturer. Applying ultraviolet and parylene coatings create similar drawbacks.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
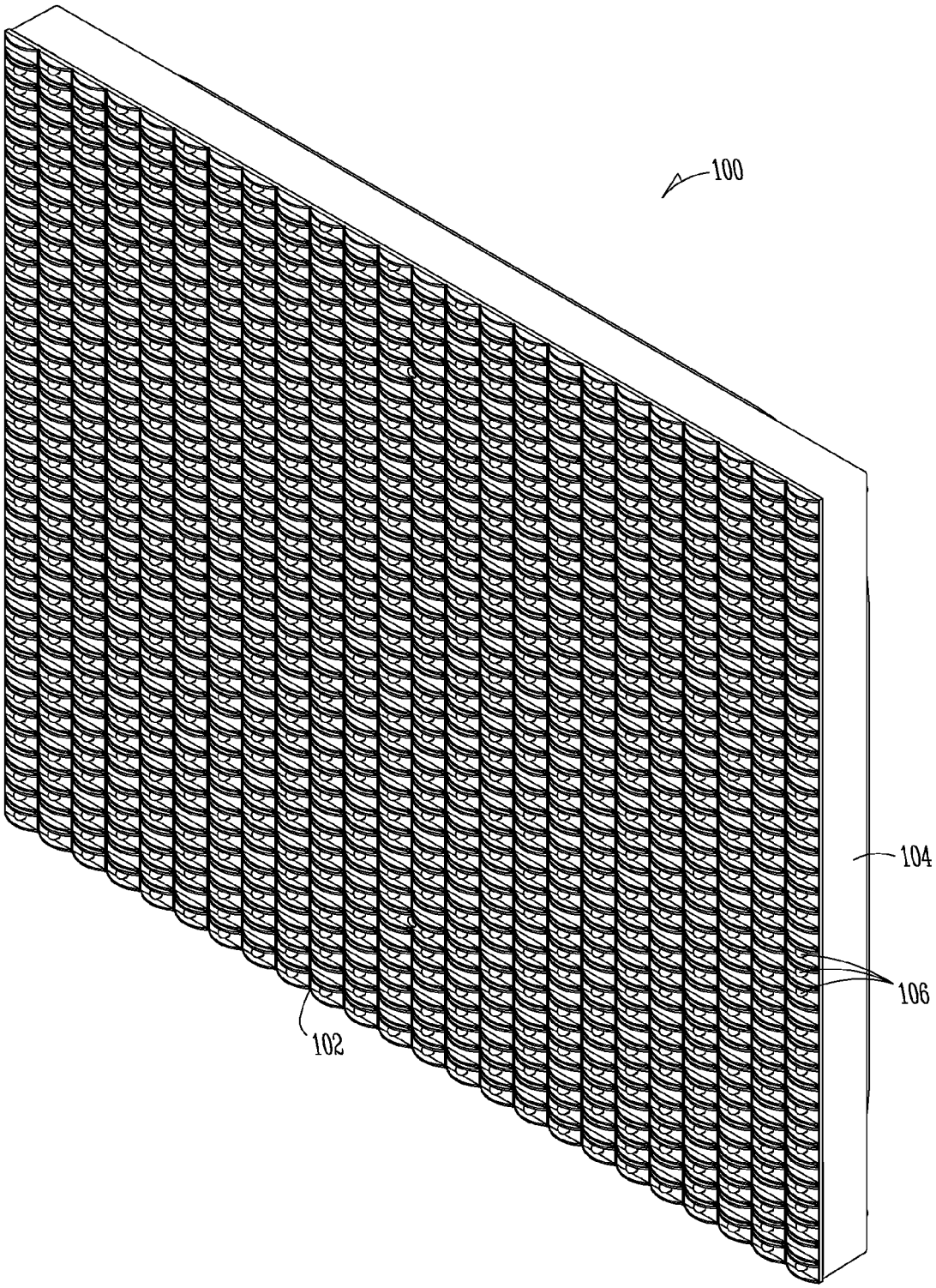
FIG. 1 Is a perspective view of one example of an LED display module.

One example of an LED display module 100 (e.g., an LED panel assembly) is shown in FIG. 1. The LED display module 100 includes an LED display surface 102 configured to provide a color display of graphics and/or video content. The LED display surface 102 is surrounded by a display edge seal 104. Referring again to the LED display surface 102, the surface includes a plurality of light emitting elements including light emitting diodes (i.e., LEDs). Each of the light emitting elements is configured to provide light to the LED display surface 102. When multiple light emitting elements 106 are seen together in close proximity various colors are shown by combining the colors of more than one light emitting element. As further described below, the LED display surface 102 includes in one example arrays of light emitting elements 106 each one of the arrays including red, green, and blue light emitting elements that cooperate to provide a spectrum of colors when one, two or three of the light emitting elements in an array are lit. In another example, the LED display surface 102 is capable of providing a black or empty surface over a portion of the display when necessary by deactivating or turning off the light emitting elements 106 in a particular portion of the LED display surface.

Figure 2A:
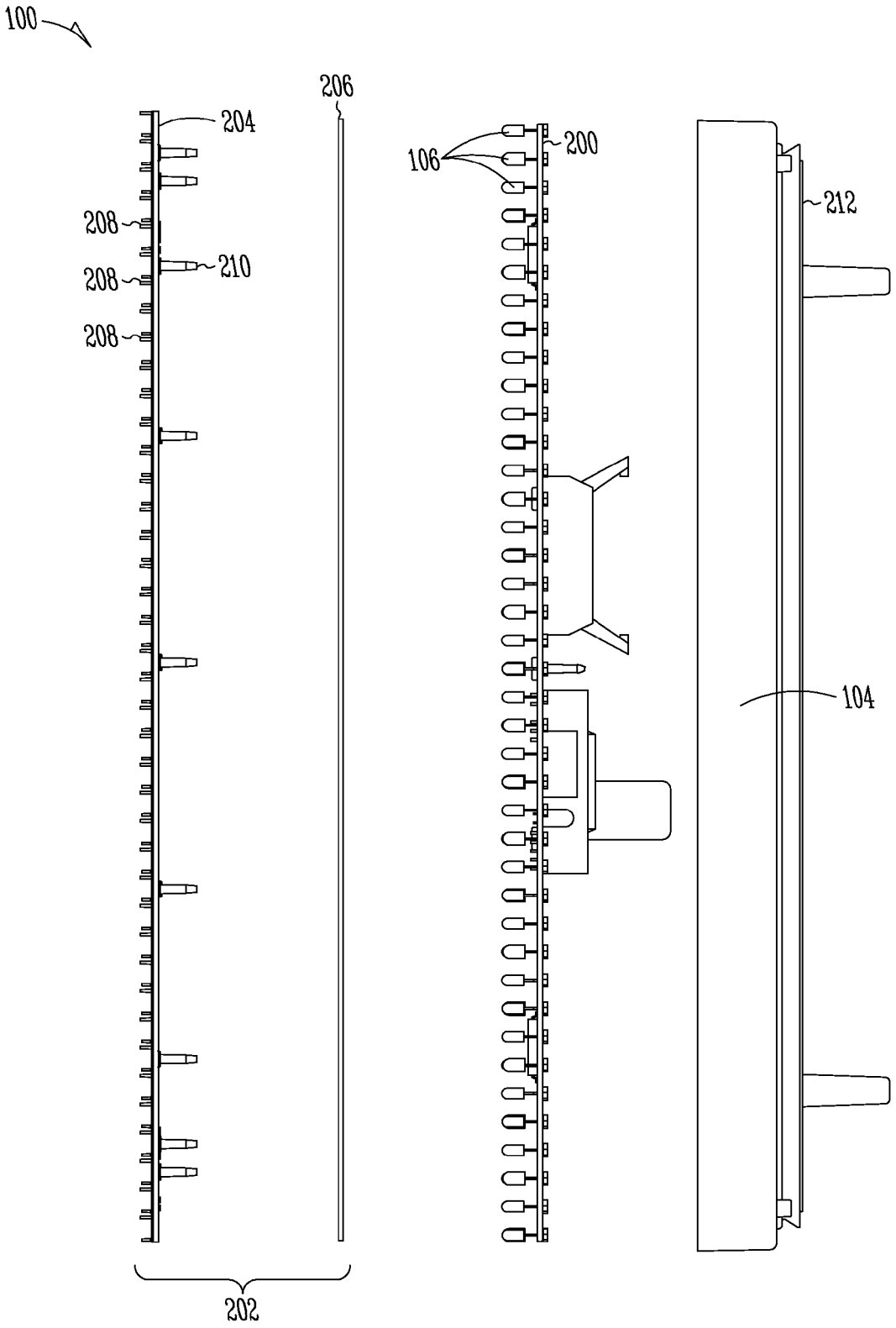
FIG. 2A Is an exploded view showing one example of the components of an LED display module seen from the side.
Figure 2B:
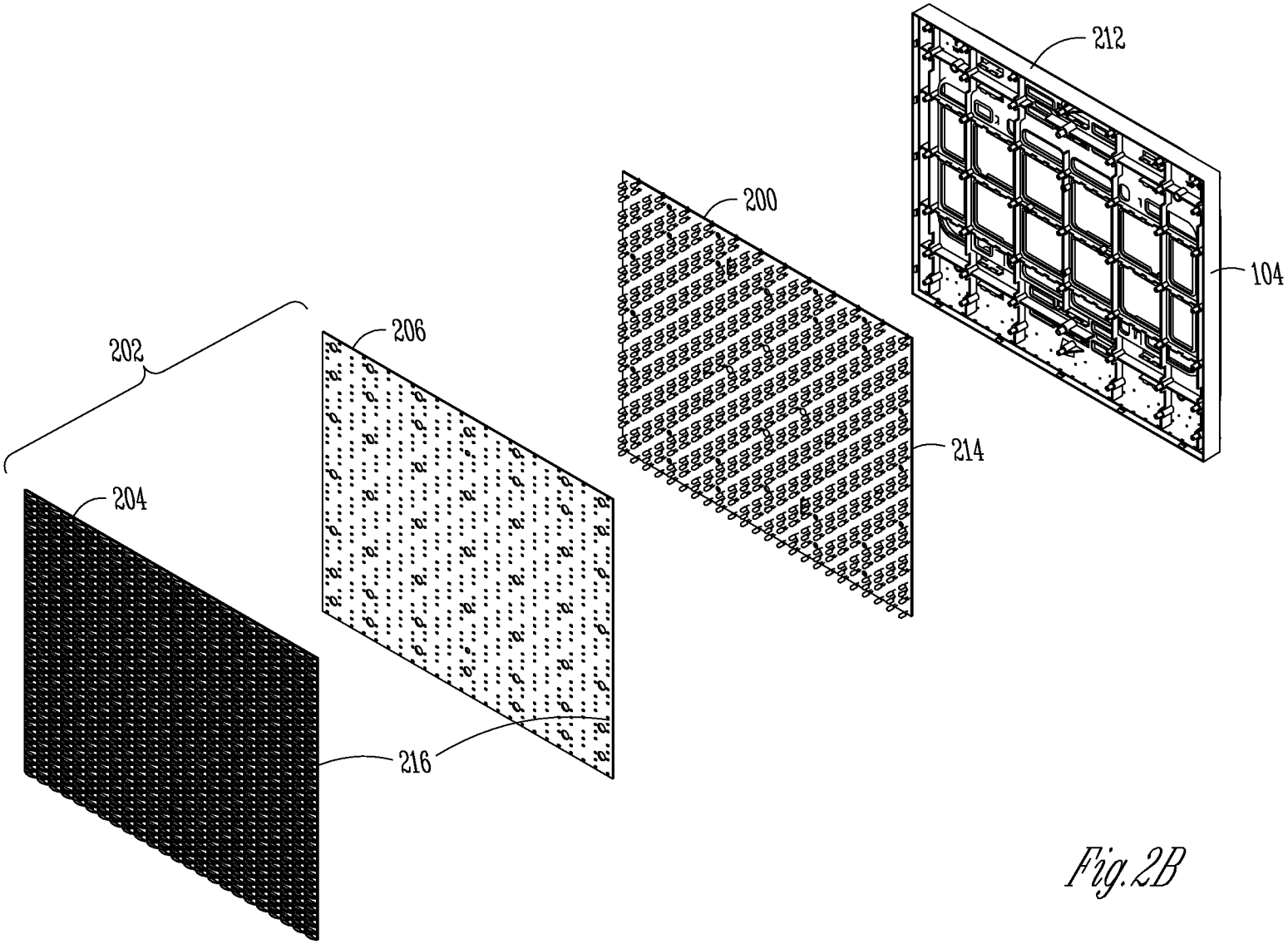
FIG. 2B Is a perspective exploded view showing the components of an LED display module shown in FIG. 2A.

One example of the LED display module 100 is shown in an exploded view in FIGS. 2A and 2B. The LED display module 100 includes a circuit board 200 coupled with a frame 212 to form a first portion of the LED display module. An LED seal louver 202 is coupled over top of the light emitting elements 106 to enclose the LED display module 100 thereby sealing out the exterior environment from the interior of the LED display module. Referring to FIGS. 2A and 2B, the LED seal louver 202 is shown in two portions including a substrate 204 and a pliable seal membrane 206. In one example, prior to assembly, the pliable seal membrane 206 is coupled with the substrate 204. For instance, the pliable seal membrane 206 is over molded onto the substrate 204 thereby making the LED seal louver 202 a unitary structure. As described in further detail below, the LED seal louver 202 includes substrate cavities and LED passages configured to receive light emitting elements 106 in a specified pattern and posture on the circuit board 200. The pliable seal membrane 206 tightly engages around each one of the light emitting elements 106 allowing the light emitting elements 106 to project through the LED seal louver 202 while sealing around each one of the light emitting elements to prevent exposure of the interior of the LED display module 100 to the exterior environment.

Referring to FIG. 2A the substrate 204 includes, in one example, louver blades 208. As further described below, the louver blades 208 extend at least partially over and under each of the light emitting elements 106 projecting through the LED seal louver 202. The louver blades 208 provide a measure of shade to each one of the light emitting elements 106. The louver blades 208 thereby assist in preventing interaction of the light emitting elements 106 with sunlight. For instance, glare including sunlight glare off of the light emitting elements 106 interferes with projection of a true color from the light emitting elements. Accurate representation of graphic and video content is frustrated by this interference. The shade provided by the louver blades 208 assists in preventing glare from the light emitting elements and additionally allows the light emitting elements to present a true color from a shaded field with minimized interaction with ambient light. Further, provision of the louver blades provides shadow in an area of the LED display surface 102 (FIG. 1). When it is desired that a portion of the surface is dark or presents a black surface when video and graphic content are displayed over other portions of the LED display surface, the shade provided by the louver blades 208 assists in ensuring the unlit portion of the surface appears black.

Referring back to FIG. 1, one example of an edge seal 104 is shown extending around the LED display module 100. Referring now to FIGS. 2A and 2B the display edge seal 104 is shown circumscribing a remainder of the frame 212 when the LED display module 100 is fully assembled. The display edge seal 104 extends from the frame 212 into engagement with at least one of the circuit board edge 214 or an LED seal louver edge 216. When engaged with the LED seal louver edge 216 the display edge seal 104 cooperates with the LED seal louver 202 to seal off the components of the LED display module 100—including the circuit board 200—from the exterior environment. The circuit board 200 is thereby protected from the elements while the light emitting elements 106 project through the LED seal louver 202 for direct visibility through the LED display surface 102. That is to say, protective features including, but not limited to, plastic screening overlays and films placed over the light emitting elements 106 are thereby substantially eliminated allowing the light emitting elements 106 to directly reside on the LED display surface 102 shown in FIG. 1.

Figure 3:
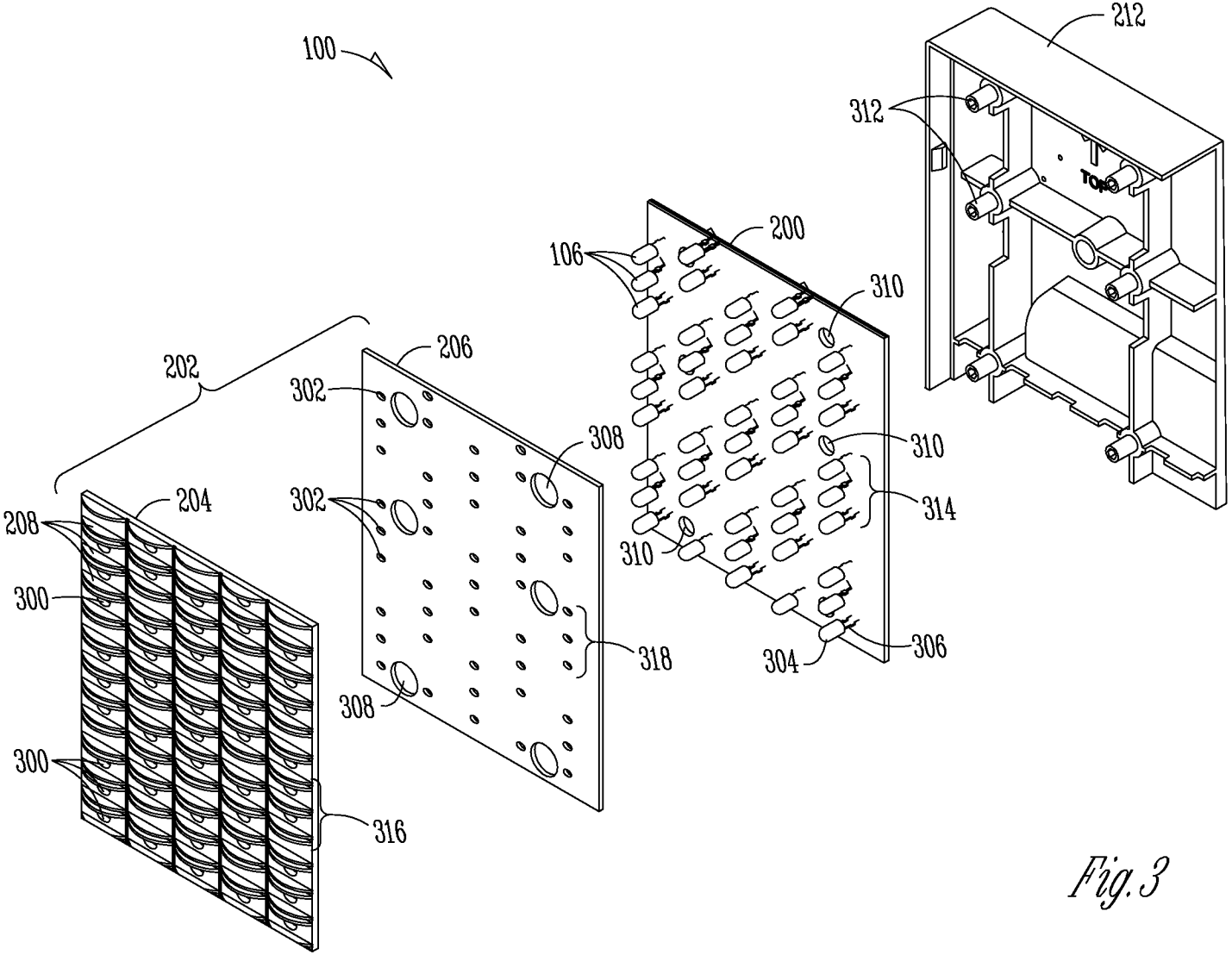
FIG. 3 Is a detailed exploded view of a portion of an LED display module including one example of an LED seal louver having a pliable seal membrane configured to seal around each individual LED.

A portion of the LED display module 100 is shown in FIG. 3, for detailed viewing of the components of the display module. As previously described, the LED display module 100 includes a frame 212, a circuit board 200 including a plurality of light emitting elements 106, and an LED seal louver 202. As described above, the LED seal louver 202 includes a substrate 204 and a pliable seal membrane 206 coupled with the substrate. In one example the pliable seal membrane 206 is overmolded with the substrate 204 to form a single piece LED seal louver 202 for coupling with the circuit board 200 and the light emitting elements 106. In one example the pliable seal membrane 206 is constructed with, but not limited to, a deformable and pliable material such as liquid silicone, rubber, thermoplastic elastomers and the like. The pliable seal membrane 206 is deformable to provide a tight interference fit around the light emitting elements 106 when coupled thereto. The pliable seal membrane 206 is coupled with the substrate 204, and the substrate 204 provides a rigid frame to support the pliable seal membrane 206 while the LED seal louver 202 is coupled with the light emitting elements 106 and the circuit board 200. In one example, the substrate 204 is constructed with a material including, but not limited to, polymer, resin, metal and the like. For example, the substrate 204 includes polycarbonate, and other similar materials capable of providing a rigid frame to support the pliable seal membrane 206.

Referring again to FIG. 3 the circuit board 200 is shown with the light emitting elements 106. Each of the light emitting elements extends away from the circuit board 200. As shown in FIG. 3, the light emitting elements 106 extend away in one example with a posture substantially orthogonal to the plane of the circuit board 200. That is to say, each one of the light emitting elements 106 extends away from the circuit board in a substantially consistent posture relative to other light emitting elements 106. The light emitting elements 106 are arranged on the circuit board 200 in this posture to ensure each of the elements provides consistent brightness and contrast to the LED display surface 102 shown in FIG. 1. As will be described in further detail below, the LED seal louver 202 substantially prevents misalignment, bending and the like of the light emitting elements 106 away from the specified posture after coupling with the circuit board 200.

The light emitting elements 106 shown in FIG. 3 include an LED bulb 304 and an LED base 306. In one example, the LED base 306 includes lead elements soldered with the circuit board 200. In another example, the light emitting elements 106 are arranged in pixel arrays 314 including, for instance, red, green, and blue light emitting elements in each one of the pixel arrays 314. With the combination of colored light emitting elements each one of the pixel arrays 314 is able to produce a variety of colors for each pixel of the LED display surface 102 (FIG. 1). The pixel arrays 314 are arranged on the circuit board 200 to provide a specified number of pixels in a specified pattern across an area of the circuit board 200. The LED display surface 102 shown in FIG. 1 has a corresponding arrangement of pixel arrays 314 because the light emitting elements 106 extend through the LED seal louver 202 in a specified pattern corresponding to the pattern formed on the circuit board 200.

The LED seal louver 202 shown in FIG. 3 includes substrate cavity arrays 316 and LED passage arrays 318 corresponding in arrangement to the pixel array 314 shown on the circuit board 200. For instance, the LED passages 302 extending through the pliable seal membrane 206 and the substrate cavities 300 extending through the substrate 204 are arranged on the substrate 204 and membrane 206 in a pattern corresponding to the specified pattern formed with the light emitting elements 106 on the circuit board 200. The light emitting elements 106 on the circuit board 200 are thereby able to pass through the LED passages 302 and substrate cavities 300 of the LED seal louver 202 in the specified pattern formed on the circuit board 200, and the LED display surface 102 thereby has the pixel array 314 arranged in the circuit board specified pattern.

As shown in FIG. 3, the substrate cavities 300 and LED passages 302 are sized and shaped on the respective substrate 204 and pliable seal membrane 206 to align when the membrane and substrate are coupled together to form the LED seal louver 202. In one example, the substrate cavities 300 are larger than the LED passages 302 and loosely receive the LED bulbs 304. As described previously, the pliable seal membrane 206 is constructed with a pliable material such as silicone. The LED passages 302 are sized to provide some degree of interference fit with the light emitting elements 106 when the light emitting elements are passed through the pliable seal membrane 206 of the LED seal louver 202. In one option, the LED passages provide up to 0.75 millimeters of interference between the light emitting elements 106 (e.g., LED bulb 304) and the pliable seal membrane 206 surrounding the LED passages 302. In another option, the pliable seal membrane 206 provides 0.1 to 0.45 millimeters interference between the seal membrane material and the light emitting elements 106 when circuit board 200 is coupled with the LED seal louver 202. The amount of interference between the pliable seal membrane 206 and the light emitting elements 106 is chosen to ensure tight sealing between the membrane and the light emitting elements over the life of the LED display module 100 (FIG. 1) and during the environmental conditions experienced by the LED display module (e.g., cold, hot, damp and dry conditions). When the LED display module 100 is assembled the LED seal louver 202 tightly seals over each one of the light emitting elements 106. Stated another way, the pliable material of the pliable seal membrane 206 surrounding each of the LED passages 302 tightly engages in an interference fit around each of the light emitting elements 106 extending through an LED passage 302. The interference fit between the pliable seal membrane 206 of the LED seal louver 202 and the light emitting elements 106 assists in ensuring the circuit board 200 is substantially sealed away from an environment exterior to the LED display module 100.

Each of the light emitting elements 106 of the pixel arrays 314 extends through the LED seal louver 202 and is directly visible on the LED display surface 102 without any intervening films, plastic screens and the like. In one option, the louver blade 208 (previously shown in FIG. 2) are provided to shade each of the light emitting elements 106 extending through the LED seal louver 202. The louver blades 208 assist in preventing refraction and reflection of sunlight otherwise incident on the light emitting elements 106. The louver blades 208 thereby maintain a consistent contrast and brightness between each one of the light emitting elements 106 providing a consistent LED display surface 102 capable of providing video and graphic content substantially without any variation across the entire display surface. The louver blades 208 further provide shade to the light emitting elements 106 when the elements of a particular pixel array 314 are unlit to form a dark or black area on the light emitting display surface 102 (FIG. 1). The shade provided by the louver blades 208 substantially prevents refraction and reflection of light off of the deactivated light emitting elements 106 to maintain a black appearance to that portion of the LED display surface 102.

In yet another option, the substrate 204 includes larger substrate cavities 300. For instance, the substrate cavities 300 are sized and shaped to receive more than one light emitting element 106 in each cavity. The pliable seal membrane 206 provides the LED passages 302 shown in FIG. 3 thereby ensuring tight engagement between the pliable seal membrane 206 of the LED seal louver 202 and the light emitting elements 106. That is to say, where the substrate 204 includes wider substrate cavities 300 the light emitting elements 106 extend through the LED passages 302 of the pliable seal membrane 206 so that one light emitting element is positioned within each LED passage 302. The light emitting elements 106 project through the substrate 204 and more than one of the light emitting elements 106 is retained in each substrate cavity 300.

As shown in FIG. 3, the pliable seal membrane 206 includes at least one membrane pin cavity 308. The circuit board 200 includes at least one circuit board pin cavity 310. A positioning pin 210 shown in FIG. 2A passes through the membrane pin cavity 308 and circuit board pin cavity 310 when the circuit board 200 is coupled with the LED seal louver 202 so the positioning pins 210 engage with pin sockets 312 formed in the frame 212 (See FIG. 3). The LED seal louver 202 with the positioning pins 210 is thereby able to sandwich the circuit board 200 including the light emitting elements 106 therebetween through coupling of the positioning pins 210 with the pin sockets 312. In another example, the LED display module 100 includes other coupling features including, but not limited to, screws, bolts, welds, adhesives and the like configured to couple the components of the LED display module together including the frame 212, circuit board 200, and LED seal louver 202.

Figure 4A:
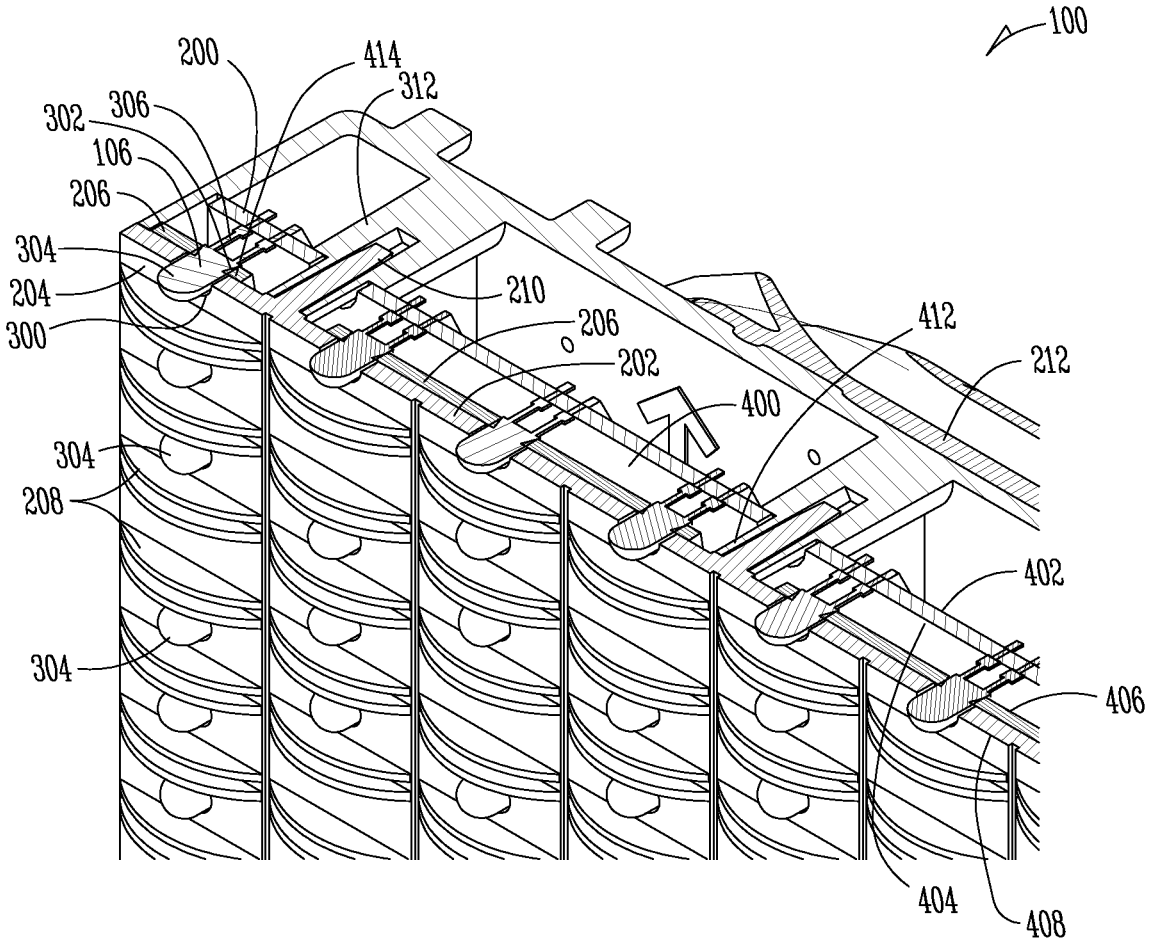
FIG. 4A Is a detailed perspective view of the portion of the LED display module shown in FIG. 3 in an assembled configuration with the LEDs positioned within the LED passages and sealed therearound with the pliable seal membrane.

A close up view of the assembled LED display module 100 is shown in FIG. 4A. The LED seal louver 202 including the substrate 204 and pliable seal membrane 206 are coupled with the frame 212 with the circuit board 200 and light emitting elements 106 retained therebetween. As shown, the light emitting elements 106 including the LED bulbs 304 extend through the substrate cavities 300 of the substrate 204 and LED passages 302 of the pliable seal membrane 206. As shown in FIG. 4A, the pliable seal membrane 206 is engaged in an interference fit 414 with the LED bulbs 304. The pliable material of the pliable seal membrane 206 deforms as the LED bulbs 304 are pressed through the pliable seal membrane 206. The pliable material thereby tightly engages in the interference fit 414 around the LED bulbs 304 creating a seal between the pliable seal membrane and the LED bulbs 304.

As shown in the example of FIGS. 4A, B the pliable seal membrane 206 is positioned at an LED seal louver rear side 406. In another example, the pliable seal membrane 206 is positioned on the LED seal louver front side 408. In the assembled configuration shown in FIGS. 4A, B, the light emitting elements 106 are positioned on the circuit board 200 with the LED bases 306 coupled with the circuit board and the LED bulbs 304 extend from the LED bases. When assembled the LED bulbs 304 project through the LED seal louver 202 and the LED seal louver is spaced a distance away from the circuit board 200. As shown in FIGS. 4A, B, the LED seal louver 202 is spaced from the circuit board 200 according to the size and shape of the positioning pins 210 and pin sockets 312. The positioning pins 210 and pin sockets 312 cooperate to ensure the LED seal louver 202 is consistently spaced away from the circuit board 200 and a consistent portion of each light emitting element 106 (e.g., LED bulb 304) extends through the LED seal louver to provide a consistent LED display surface 102 without variations in contrast or brightness. The consistent spacing provided by the positioning pins 210 and pin sockets 312 ensure the LED display module 100 has a consistent display across its display surface 102 because each of the light emitting elements 106 of the pixel arrays 314 (FIG. 3) are exposed through the LED seal louver 202 in the same manner (e.g., the same length of the bulbs 304 projects from the LED seal louver 202).

In another example, the LED seal louver 202 and the positioning pins 210 cooperate to form an LED support skeleton 412. As described above, the positioning pins 210 reliably position the LED seal louver 202 over the circuit board 200 and align the light emitting element 106 with the LED passages 302 and substrate cavities 300 of the LED seal louver. When the LED seal louver 202 is coupled with the circuit board 200 the light emitting elements 106 are guided through the LED passages 302 and the substrate cavities 300 and held therein with the interference fit 414 of the pliable seal membrane 206. The pliable seal membrane 206 thereby holds each of the light emitting elements 106 in a specified pattern and specified posture. For instance, the LED support skeleton 412 holds the light emitting elements 106 in the specified pattern shown in FIG. 3 where each of the light emitting elements 106 is positioned on the circuit board 200 in a pixel ray 314. The LED seal louver 202 further ensures the light emitting elements 106 are retained in the specified posture, for example, an orthogonal posture relative to the circuit board 200. The LED seal louver 202 thereby substantially prevents bending and misalignment of the light emitting elements 106 shown in the LED display surface 102 (FIG. 1). The positioning pins 210 cooperate with the pin sockets 312 to properly align the LED seal louver 202 on the LED display module 100. When properly aligned the LED seal louver 202 provides a framework for supporting the light emitting elements 106 and maintains each light emitting element 106 in the specified pattern and specified posture shown for example in FIGS. 4A and 4B and shown initially without the LED seal louver in FIG. 3. Immobilization of the light emitting elements 106 in the specified pattern and specified posture through the LED seal louver 202 as part of the LED support skeleton 412 prevents misalignment and thereby eliminates tedious and time consuming labor in the field and at the factory to realign light emitting elements 106 that have otherwise become bent during manufacturing, storage, transport and use. The LED support skeleton 412 in other examples is aligned with the light emitting elements and coupled with one of the circuit board 200 and the frame 212 with other features, including but not limited to, mechanical fittings, welds, rivets, adhesives and the like.

Figure 4B:
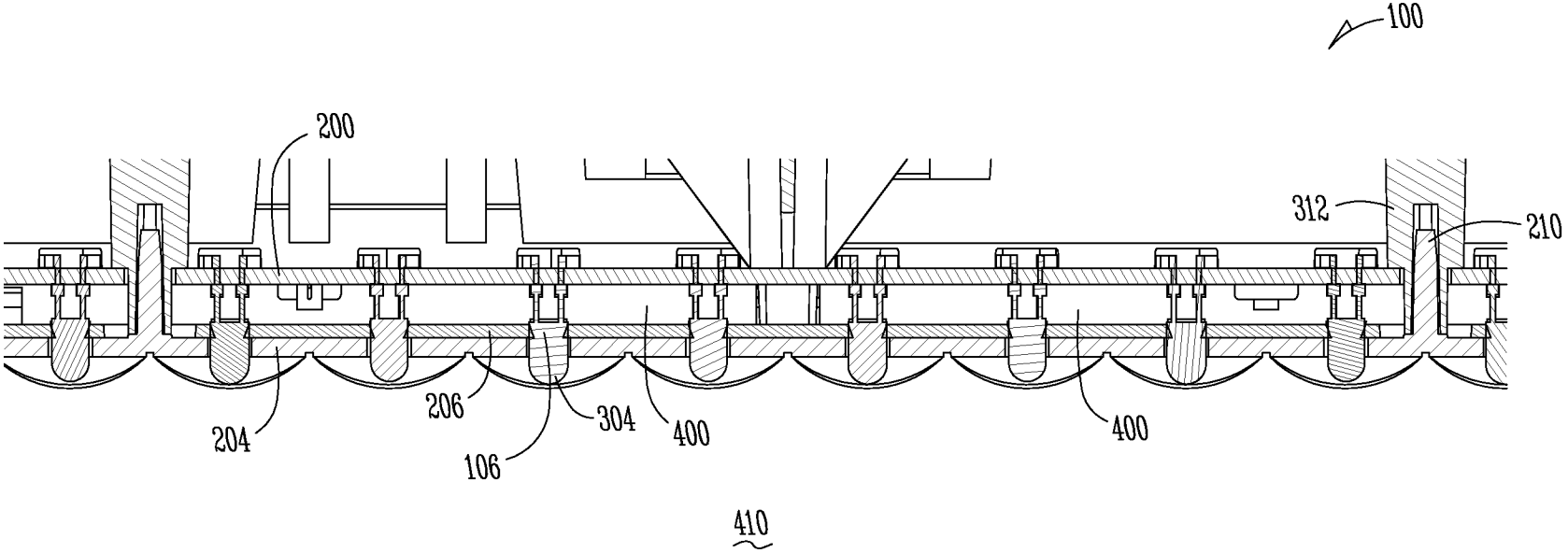
FIG. 4B Is a cross-sectional view of the LEDs positioned within the LED seal louver with the LED seal louver spaced from the circuit board.

An air gap 400 is disposed between the LED seal louver 202 and the circuit board 200. Referring to FIGS. 4A and 4B, the air gap 400 is formed according to the configuration of the positioning pins 210 and pin sockets 312, in one example. Extending or shortening the length of one or both of the positioning pins 210 and the pin sockets increases or decreases the distance of the LED seal louver 202 from the circuit board and the corresponding air gap 400 therebetween. As described above, the LED seal louver 202 is spaced away from the circuit board 200 to ensure an interference fit 414 around each of the light emitting elements 106 and provide a weather seal against the exterior environment 410 shown in FIG. 4B. The air gap formed between the LED bulb 304 and the circuit board 200 is formed by this spacing of the LED seal louver 202 from the circuit board. The air gap 400 provides insulation to the circuit board 200 and the electronics of the LED display module 100. In warm and cold weather the air gap 400 minimizes temperature fluctuations and temperature cycling of the circuit board 200 thereby extending the life and minimizing maintenance of the circuit board 200 in the light emitting elements 106 coupled thereto. Stated another way, the air gap 400 assists in maintaining the circuit board 200 and light emitting elements 106 within a specified range of temperatures and minimizes large changes in temperature on the circuit board due to the cyclical heating and cooling over a series of days, weeks and between seasons.

Figure 5:
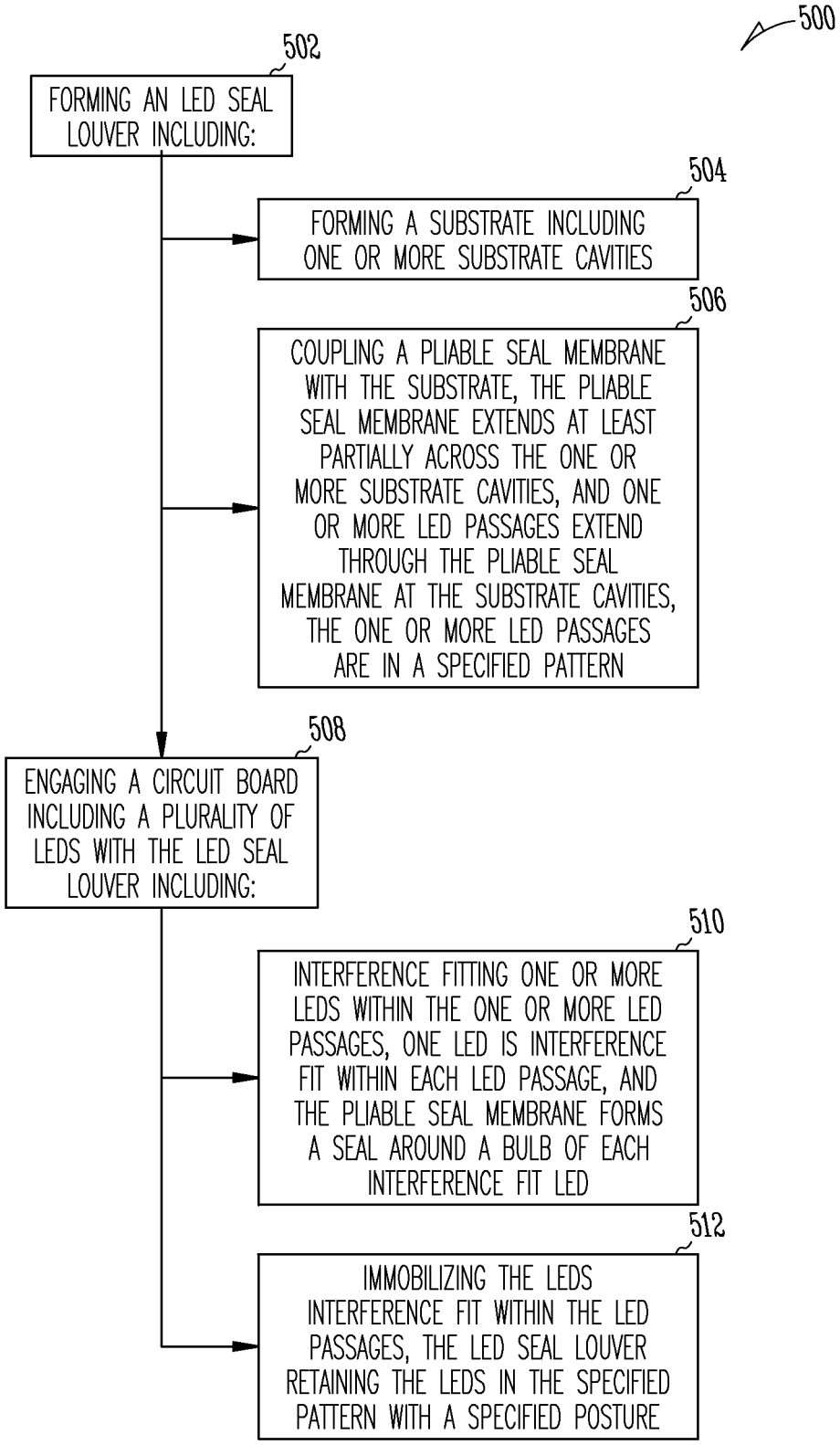
FIG. 5 Is a block diagram showing one example of a method of making an LED display module.

FIG. 5 shows one example of a method 500 for forming an LED panel assembly such as the LED display module 100 shown in FIG. 1. In the description of the method 500 reference is made to elements previously described above shown in the figures. Elements and features referred to in the description of the method 500 are not intended to be exclusive but are intended to include any of the examples described in the specification and their equivalents.

In 502 an LED seal louver, such as LED seal louver 202 shown in FIGS. 2A and 2B is formed. In one example, the LED seal louver 202 includes a substrate 204 and the substrate 204 is formed with one or more substrate cavities 300 (FIG. 3). At 506, a pliable seal membrane 206 is coupled with the substrate 204. Pliable seal membrane 206 extends at least partially across the one or more substrate cavities 300 and one or more LED passages 302 extend through the pliable seal membrane 206. As previously described, in one example the one or more LED passages 302 are aligned with the substrate cavities 300. In another example, the one or more LED passages 302 aligned with the substrate cavities 300 are in a specified pattern corresponding with a specified pattern of pixel arrays 314 on a circuit board 200 (FIG. 3). In still another example, each substrate cavity 300 includes one or more LED passages 302. That is to say, one or more LED passages 302 extend through the pliable seal membrane 206 and are collectively aligned with one larger substrate cavity 300. The LED passages 302, in this example, are thereby fit within a single substrate cavity 300. As described above, the pliable material of the pliable seal membrane 206 continues to seal around each LED bulb 304 within each LED passage 302 where the substrate cavities 300 include a plurality of LED passages 302.

The method 500 further includes engaging a circuit board 200 including a plurality of light emitting elements 106, such as LEDs with the LED seal louver 202. Engaging the circuit board with the LED seal louver includes, in one example, at 510 interference fitting one or more light emitting elements 106 within the one or more LED passages 302 where one light emitting element 106 is interference fit within each LED passage 302. Stated another way, the pliable material of the pliable seal membrane 206 extends around and engages with a single light emitting element 106 in each LED passage 302. Referring to FIG. 4, the light emitting elements 106 are each coupled with the LED seal louver 202 at an interference fit 414. Each of the plurality of light emitting elements 106 are sealed by the pliable seal membrane 206 thereby substantially isolating the circuit board 200 from an exterior environment 410 (FIG. 4B). While the circuit board 200 is isolated from the exterior environment each 410 of the light emitting elements 106 are project through the LED seal louver 202 including the substrate 204 and the pliable seal membrane 206. Each of the light emitting elements 106 are thereby directly visible on the display surface 102 shown in FIG. 1 while the underlying circuit board is isolated from the exterior environment. In another example, engaging the circuit board with the LED seal louver 202 as described at 508 includes at 512, immobilizing the light emitting elements 106 interference fit within the LED passages 302. The LED seal louver 202 is thereby able to retain the light emitting elements 106 in a specified pattern and a specified posture. For instance, the specified posture includes the orientation of the light emitting elements 106 as they extend away from the circuit board 200. The LED seal louver 202 thereby forms an LED support skeleton, such as the support skeleton 412 shown in FIG. 4. The LED seal louver 202 is supported in the LED display module 100, for instance, through coupling of positioning pins 210 with pin sockets 312 on the frame 212. Fixing the LED seal louver 202 to the frame 212 ensures that the light emitting elements 106 interference fit within each of the LED passages 302 are correspondingly fixed in the specified pattern and specified posture as arranged on the circuit board 200. Time intensive and labor intensive manufacturing steps are thereby avoided because each of the light emitting elements 106 are retained in the specified pattern and the specified posture through the LED support skeleton 412 including the LED seal louver 202 cooperating with the positioning pins 210.

Several options for the method 500 follow. In one example, coupling the pliable seal membrane 206 with the substrate 204 includes overmolding the pliable seal membrane onto the substrate. In still other examples, coupling the pliable seal membrane with the substrate includes bonding the pliable seal membrane with the substrate, including but not limited to, welding, adhering, mechanically interfitting and the like. In another example, engaging the circuit board 200 including the plurality of the light emitting elements 106 with the LED seal louver 202 includes forming an air gap, such as air gap 400 (FIG. 4), between the LED seal louver and the circuit board. The air gap extends across the circuit board 200. In another example, the air gap 400 extends across the entire circuit board 200. In still another example, the method 500 includes coupling an edge seal, such as display edge seal 104, around the circuit board 200 and the LED seal louver 202. The display edge seal 104 extends from a circuit board edge 214 to an LED seal louver edge 216. In yet another example, the method 500 further includes isolating the circuit board 200 from an exterior environment 410 by way of the interference fit 414 of the light emitting elements 106 and the coupling of the display edge seal 104.

CONCLUSION

The LED display module including the LED seal louver having a substrate and a pliable seal membrane seals the LED display module allowing each of the light emitting elements to protrude through the LED seal louver for direct viewing on the LED display surface. The light emitting elements project through the LED seal louver, and the pliable material in the LED seal louver extends around and interference fits with each light emitting element to substantially isolate the underlying circuit board from the environment exterior to the LED display module. Provision of the LED seal louver substantially eliminates the need for supplemental sealing techniques including potting or coating of the circuit board surface and the light emitting elements extending therefrom. The LED display module including the LED seal louver is thereby lighter than previous LED display modules having a potting or coating surface for sealing the light emitting element and the circuit board from the exterior environment. Additionally, provision of the LED seal louver eliminates additional manufacturing steps including pouring of potting material, curing of the potting material, and subsequent testing of the LED display module to ensure proper alignment of each of the light emitting elements relative to the other light emitting elements on the circuit board. Stated another way, bending and misaligning of light emitting elements is avoided because the light emitting elements are not engaged with potting material poured around the light emitting elements during manufacture. Tedious and time consuming labor whether during manufacture or at a delivery site to realign the light emitting elements to provide a consistent LED display surface is thereby substantially avoided. Similarly, the provision of the LED seal louver eliminates manufacturing steps needed to apply coatings including ultraviolet and parylene coatings.

Additionally, the LED seal louver cooperates with the remainder of the LED display module to provide an LED support skeleton sized and shaped to engage with each of the light emitting elements extending through LED passages of the LED seal louver. The pliable seal membrane engages around each of the light emitting elements and substantially ensures the light emitting elements are maintained in the specified pattern and specified posture as they are arranged on the circuit board. For instance, the LED seal louver is aligned with the LED display module (including the circuit board having the light emitting elements) by positioning pins that are engaged with corresponding pin sockets. This alignment of the LED seal louver fixes the LED seal louver in place and provides the support skeleton for engagement with the light emitting elements. The LED seal louver cooperates with, the positioning pins for example, to substantially immobilize the light emitting elements and prevent misalignment of the light emitting elements thereby maintaining the desired appearance and display characteristics of the LED display surface.

Further, the air gap formed between the LED seal louver spaced from the circuit board provides insulation for the circuit board from cyclical temperature fluctuations due, for example, to seasonal changes, weather changes, temperature changes and the like. The circuit board is thereby exposed to substantially less dynamic heat loading providing a greater operating life for the circuit board and correspondingly decreasing field maintenance.

Although the present invention has been described in reference to preferred embodiments, persons skilled in the art will recognize that changes may be made in form and detail without departing from the spirit and scope of the invention. It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the invention should, therefore, be determined with reference to the appended claims, along with the full scope of equivalents to which such claims are entitled.

What is claimed is:

1. An LED panel assembly comprising:

a circuit board including a plurality of LEDs;

an LED seal louver coupled over the circuit board, the LED seal louver includes:

a substrate including one or more substrate cavities, each of the one or more substrate cavities is sized and shaped to loosely receive an LED, a pliable seal membrane coupled with the substrate, the pliable seal membrane includes a pliable material partially extending across the one or more substrate cavities, one or more LED passages extends through the pliable material adjacent to the substrate cavities, each of the LED passages is sized and shaped to receive a single LED, and bulbs for one or more of the plurality of LEDs are correspondingly received within the LED passages, and the pliable material seals around each bulb with an interference fit; and wherein the bulbs for one or more of the plurality of LEDs are visible through the LED seal louver while the pliable seal membrane is sealed around the bulbs, and the LED seal louver seals off the circuit board from an environment exterior to the LED panel assembly.

2. The LED panel assembly of claim 1, wherein the LED seal louver with the pliable seal membrane sealed around the bulbs seals and isolates the circuit board from an environment exterior to the LED panel assembly.

3. The LED panel assembly of claim 1, wherein the plurality of LEDs are positioned in arrays on the circuit board, and the LED passages are arranged in corresponding arrays.

4. The LED panel assembly of claim 3, wherein the plurality of LEDs are positioned in arrays including a red, green and blue LED in each array.

5. The LED panel assembly of claim 1, wherein the LED passages are positioned between louver blades extending from a substrate exterior surface, and the louver blades extend at least partially over and under each LED received in each LED passage.

6. The LED panel assembly of claim 1, wherein the LED seal louver is spaced from the circuit board with an air gap therebetween.

7. The LED panel assembly of claim 1, wherein one or more of the LEDs are received in the LED passages with one LED per passage, the pliable seal membrane is engaged around the bulb perimeter of each LED received in the LED passages and immobilizes the LEDs received therein in a specified pattern and in a specified posture.

8. The LED panel assembly of claim 7, wherein the pliable seal membrane is more flexible than the substrate.

9. The LED panel assembly of claim 7, wherein the pliable seal membrane is on the interior side of the LED seal louver.

10. The LED panel assembly of claim 7, further comprising an LED support skeleton including:

one or more positioning pins coupled between the LED seal louver and the circuit board, the LED seal louver, and wherein the LED seal louver is engaged with each of the plurality of LEDs received within the LED seal louver, and the one or more positioning pins support the LED seal louver while the LED seal louver supports each of the plurality of LEDs received therein to maintain the plurality of LEDs received within the LED passages in the specified pattern and in the specified posture.

11. A method for making an LED panel assembly comprising:

forming an LED seal louver including:

forming a substrate including one or more substrate cavities, and coupling a pliable seal membrane with the substrate, the pliable seal membrane extends at least partially across the one or more substrate cavities, and one or more LED passages extend through the pliable seal membrane at the substrate cavities, the one or more LED passages are in a specified pattern;

engaging a circuit board including a plurality of LEDs with the LED seal louver including:

interference fitting one or more LEDs within the one or more LED passages, one LED is interference fit within each LED passage, and the pliable seal membrane forms a seal around a bulb of each interference fit LED, and immobilizing the LEDs interference fit within the LED passages, the LED seal louver retaining the LEDs in the specified pattern with a specified posture.

12. The method for making the LED panel assembly of claim 11, wherein coupling the pliable seal membrane with the substrate includes overmolding the pliable seal membrane on the substrate.

13. The method for making the LED panel assembly of claim 11, wherein immobilizing the LEDs interference fit within the LED passages includes forming an LED support skeleton with one or more positioning pins coupled between the LED seal louver and the circuit board and the LED seal louver, the one or more positioning pins and the LED seal louver cooperate to maintain the plurality of interference fit LEDs in the specified pattern and in the specified posture.

14. The method for making the LED panel assembly of claim 11, further comprising coupling an edge seal around the circuit board and the LED seal louver, wherein the edge seal extends from a circuit board edge to an LED seal louver edge.

15. The method for making the LED panel assembly of claim 14, further comprising isolating the circuit board from an exterior environment with the interference fitting of the LEDs and the coupling of the edge seal.

* * * * *